United States Patent [19]

Berry et al.

[11] 4,262,371

[45] Apr. 21, 1981

[54] AIR-WATER OUTLET FITTING

[76] Inventors: Desmond J. Berry; Larry Blankfield, both of 14 Century Dr., Braeside, Victoria, 3195, Australia

[21] Appl. No.: 8,056

[22] Filed: Jan. 31, 1979

[30] Foreign Application Priority Data

Nov. 2, 1978 [AU] Australia ..... PD6617

[51] Int. Cl.[3] ..... B05B 15/08; A61H 9/00; E04H 3/16

[52] U.S. Cl. ..... 4/191; 128/66; 239/420; 239/587; 239/600; 4/492; 4/542

[58] Field of Search ..... 4/1, 145, 172, 172.15, 4/172.16, 172.17; 128/66; 239/420, 424, 587, 589, 600

[56] References Cited

U.S. PATENT DOCUMENTS

| | | | |
|---|---|---|---|
| 2,990,122 | 6/1961 | Blumberg et al. | 23/587 X |
| 3,471,091 | 10/1969 | Baker | 239/587 X |
| 3,515,354 | 6/1970 | Presson | 239/424 X |
| 3,662,406 | 5/1972 | Giglio | 128/66 X |
| 3,890,655 | 6/1975 | Mathis | 128/66 X |
| 3,905,358 | 9/1975 | Jacuzzi | 128/66 |
| 3,946,449 | 3/1976 | Mathis | 128/66 X |
| 3,985,303 | 10/1976 | Steimle | 239/587 X |
| 4,082,091 | 4/1978 | Raab | 128/66 |

*Primary Examiner*—Stuart S. Levy

*Attorney, Agent, or Firm*—Trexler, Wolters, Bushnell & Fosse, Ltd.

[57] ABSTRACT

An outlet for use with spa pools or the like where water and air are mixed by a "Venturi Pump" to provide a water/air stream, the outlet having a direction control device for controlling the direction of the water/air stream, the "Venturi Pump" being located within the direction control device.

8 Claims, 4 Drawing Figures

AIR-WATER OUTLET FITTING

BACKGROUND OF THE INVENTION

This invention relates to outlets and refers particularly, though not exclusively, to outlets for use with spa pools or the like.

Spa pools normally have one or more water outlets in the wall thereof wherein water under pressure is returned to the pool with air being admixed therewith so as to provide a pleasant and relaxing effect to any person in the pool. The water/air mixture is occasionally provided with a pulsing effect to increase the relaxing effect upon the muscles of such a person. It has been found desirable to provide these outlets with a form of direction control so that such a person can control the direction of flow of the water so that it may be directed upon certain parts of the body to enhance the effect.

One prior system for providing this effect and to provide for the necessary outlet was to provide a Venturi effect to mix the air and the water and to then pass the mixed air and water through an eye ball socket so as to control the direction of flow. This prior system has a large number of inherent problems in that the outlet ball tended to become slightly deformed and non-spherical and was therefore difficult to move. When this occurred the retaining flange had to be slightly released, the ball turned and then the flange tightened. When the flange was tightened the ball tended to move out of position. Furthermore, due to the distance between the actual Venturi and the outlet ball, the pulsing and air effect in the water tended to be affected. Furthermore, the ball tended to act as a concentrating beam so that the water outlet was more of a concentrated form and this did not provide the necessary pleasurable sensation. Further complications arose due to the necessary arrangement of the supply pipes. These supply pipes have tended to be of rather large size and this has required extra concrete thickness when dealing with concrete pools. This, naturally, has increased the cost of the pool and decreased its efficiency.

The main problem was that the direction control simply did not work. If the eye ball were turned so that the water/air stream should have been 30° off axis, the stream may have varied by only one or two degrees. This happens due to the extremely high turbulance of the water/air stream which affected the ability of the stream to be deflected.

SUMMARY OF THE INVENTION

It is therefore the principal object of the present invention to provide outlets of the above described nature which attempt to overcome the deficiencies of the aforesaid prior art.

With the above and other objects in mind, the present invention provides an outlet having a body with an inlet end having an inlet for water and an inlet for air, an outlet end having an outlet for water and an outlet for air, and a direction control device at said outlet end; said outlet for water and said outlet for air being formed at said direction control device and being arranged to form a Venturi within said direction control means.

BRIEF DESCRIPTION OF THE DRAWINGS

In order that the invention may be fully understood and readily put into practical effect there shall now be described by way of non-limitative example only preferred constructions of an outlet incorporating the provisions of the present invention, the description being with reference to the accompanying illustrative drawings. In the drawings.

DETAILED DESCRIPTION OF THE PREFERRED EMBODIMENT

Figure 1:
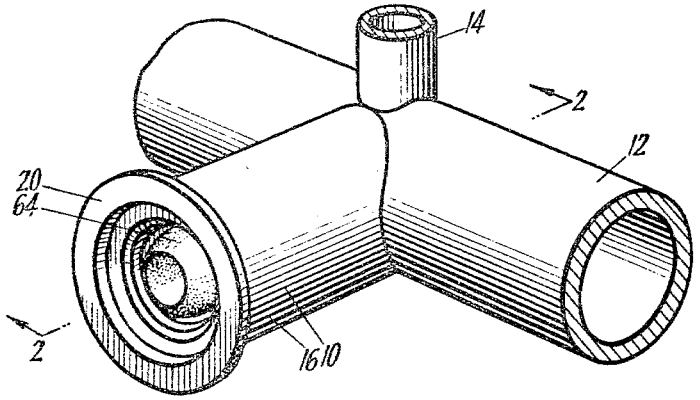
FIG. 1 is a perspective view of the outlet.
Figure 2:
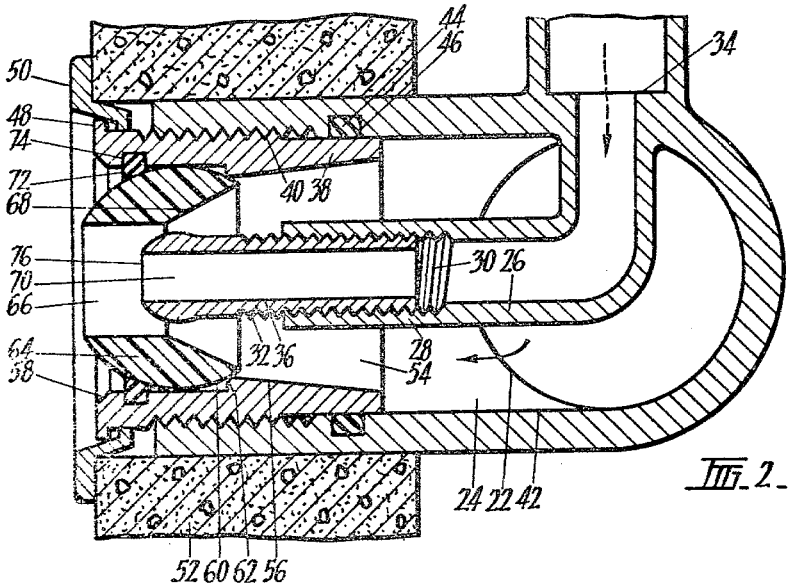
FIG. 2 is a vertical cross-section along the lines of and in the direction of arrows 2—2 of FIG. 1.

To refer to FIGS. 1 and 2, the outlet shown is approximately T-shaped and has a hollow body portion 10, a water supply pipe 12, and an air supply pipe 14. At the outer-end 16 of the body portion 10 there is an eye ball 64 and a flange 20 for holding the eye ball 18 in position relative to the body 10. An air tube extends through the interior of body 10.

The water supply pipe 12 is a continuous pipe with an opening 22 into the interior 24 of body portion 10, the pipe 12 is of a diameter such that the normal return-to-pool pipe can be located tightly within pipe 12.

The air supply pipe 14 passes radically through water pipe 12, curves through 90° at, approximately the longitudinal axis of water pipe 12, and passes through opening 22 and into the interior 24 of body 10. The portion 26 of pipe 14 within the body 10 is located along the longitudinal axis of body 10 and extends for approximately half of the length of the body 10. The outer end 28 of pipe portion 26 has an internal screw-thread 30 adapted to threadingly receive the correspondingly threaded inner end 32 of air tube 36. The air tube 14 is stepped at 34 to receive a pipe (not shown) of suitable diameter being part of an air supply system (not shown).

At the outer end 16 of body 10 is the flange 20 and eye ball 64. The flange 20 has a skirt 38 which threadingly engages in a threaded portion 40 of bore 42 of the outer end 16 of body 10 as well as a sealing O-ring 44 located in a groove 46 in bore 42. The O-ring 44 prevents water from passing between the body 10 and skirt 38. The flange 20 has an outer peripheral ring 48 adapted to engage a sealing ring 50 which seals on a pool wall 52 to prevent water passing between the body 10 and the pool wall 52. The flange 20 has a bore 54 which has a tapered inner end 56 and a countersunk outer end 58. Between the ends 56 and 58 of bore 54 is a central portion 60 which creates a step 62 where it meets inner end 56. The central portion 60, in combination with the step 62, holds in place an eye ball 64. The eye ball 64 is a portion of a sphere and has a water passage 66 therethrough along the longitudinal axis of the eye ball 64. The passage 66 flares radially outwardly toward the inner regions of the eye ball to create a flared water inlet region 68 which tends to blend with the tapered inner end 56 of flange 20. The eye ball 64 is prevented from outwards movement by an O-ring 72 in a groove 74 in central portion 60 of bore 54. This O-ring 72 also provides a sealing action so that all water must pass through passage 66.

As is described above, the air tube 36 extends longitudinally outwardly from pipe portion 26. The air tube extends along the body 10 such that the outer end 76 thereof is located at the geometric centre 70 of the eye ball 64. This means that if the eye ball 64 is rotated so that the direction of the outflow of water from the passage 66 is altered, the end 76 of air tube 36 is still at the geometric centre of the eye ball 64. Furthermore, the end 76 of air tube 36 is provided with a bulbous portion 78, the purpose of which will be understood from the following description. Due to the threaded engagement of tube 36 in portion 26, the position of end 76 of tube 36 relative to the geometric centre 70 of eye ball 64 can be changed. However, for optimum results, the end 76 should be at the geometric centre 70.

Due to the arrangement of the bulbous head 78 within the passage 66 through eye ball 64, there is created what is known as a Venturi effect. This results from the reduction in diameter of the passage 66 along the flared portion 68, which causes the velocity of the water passing through the passage 66 to increase in proportion to the reduction in diameter. The presence of the air tube 36 within the flared portion 68 means that the increase in velocity of the water as it passes the bulbous head 78 causes the air to be sucked out of the tube 36 and to be mixed with the water. This effect is known as the Venturi effect and the apparatus is known as a Venturi pump. Therefore, the air and water are mixed as is desired.

The principle advantage here is that the eye ball 64 can be moved to direct the water flow without adversely effecting the Venturi effect. This is because the outlet from the air tube 36 is located at approximately the geometric centre 70 of the eye ball 64 and as the eye ball 64 is approximately spherical it will be, in effect, pivoting about the point at the centre of the bulbous head 78. Therefore, the bulbous head 78, which is where the outlet of the air is located, is always at the centre of the water flow. Therefore, there is no reduction in the Venturi effect nor of the water flow due to a change in the direction of the water flow.

Furthermore, as the air tube 36 is located within the air tube portion 26 in a threading engagement, by adjusting the length of inter-engagement between the portion 26 and tube 36, the location of the bulbous head 78 within the passage 66 can be varied so as to provide a change in the actual water flow. As the bulbous head 78 is located within the centre of the water flow, the water flow tends to have an annular pattern and therefore by adjusting its location within the flared portion 68 of the water passage 66, the nature of this annular water flow can be varied.

Figure 3:
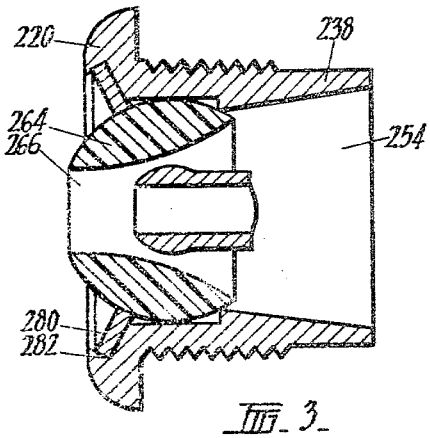
FIG. 3 is a partial cross-section similar to FIG. 2 showing an alternative construction.

To now refer to FIG. 3, there is shown an alternative way in which the eye ball is constructed and held in place. For simplicity, those components not relative to changes have not been shown and like numbers are used for like parts, but with a prefix number 2 added.

Here, the flange 20 and sealing ring 50 have been combined into a single sealing flange 220. This is used in exactly the same way as flange 20 described above. The bore 254 through flange 20 and skirt 238 are the same as those described above. The eye ball 264 is retained in position as before, except that a circlip 280 is used to prevent axially outwardly movement of eye ball 264. The circlip 280 is held in place in a shaped groove 282 in flange 220 and is retained in the groove 282 by spring effect or glueing. Furthermore, the passage 266 through the eye ball 264 is changed so that it continually tapers radially inwardly along its length in a curved fashion. This provides for a more accurate control of the water flow.

Figure 4:
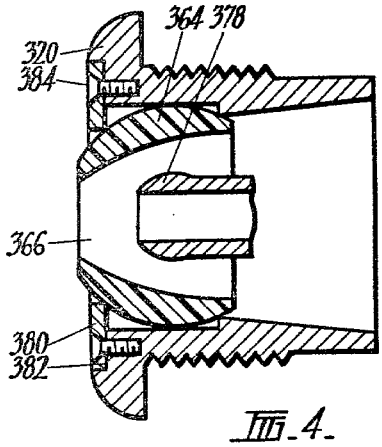
FIG. 4 is a view corresponding to FIG. 3 but showing a further alternative construction.

To now refer to FIG. 4, there is shown a further alternative way in which the eye ball is constructed and held in place. For simplicity, those components not relative to changes have not been shown, and like numbers are used for like parts but with a prefix number 3 added.

Here, like FIG. 3, the flange 20 and sealing ring 50 have been combined into a single sealing flange 320. This is used in exactly the same way as is described above. The eye ball 364 is retained in position for this construction by a holding ring 380. The ring 380 is held in a groove 382 in flange 320 by means of screws 384. Furthermore, the passage 366 through eye ball 364 is changed so that it curves in the reverse way to that of FIG. 3. This provides for a large control over the water flow as a small change in water flow results from a large movement of bulbous head 378.

Whilst there has been described in the aforegoing description a preferred construction of an outlet according to the present invention, it will be realised by those skilled in the art that many variations or modifications in details of design or construction may be made without departing from the essential nature of the present invention as will be understood from the following claims.

What we claim is:

1. An outlet having a body with an inlet end having an inlet for water and an inlet for air, an outlet end having an outlet for water and an outlet for air, and direction control device at said outlet end; said outlet for water and said outlet for air being formed at said direction control device and being arranged to form a venturi within said direction control device; said direction control device being formed as an eye ball having a tapered passage therethrough, said tapered passage being said outlet for water; said outlet for air being formed as an air tube, the outlet ends of said water and air outlets being located in said tapered passage; said outlet end of said air tube having formed thereon a bulbous head to provide for an annular water flow pattern and to assist in the formation of said venturi; flange means having a bore for mounting said eye ball therein, said flange means having a skirt so as to mount said skirt in said body; and an O-ring in said body so as to provide a water-tight seal between said skirt and said body.

2. An outlet as claimed in claim 1, wherein the outlet end of said air tube is located in said tapered passage at approximately the geometric center of said eye ball.

3. An outlet as claimed in claim 2, wherein said air tube is adjustably mounted in an air supply pipe so as to provide adjustment of said outlet end of said air tube relative to said tapered passage to control and adjust the water flow pattern.

4. An outlet as claimed in claim 1, wherein said bore comprises a tapered inner end, a countersunk outer end, and a cylindrical central portion; the junction of said tapered inner end and said cylindrical central portion providing a step so as to retain said eye ball against axially inwards movement.

5. An outlet as claimed in claim 4, wherein said eye ball is retained against axially outward movement by an O-ring located in a groove in said cylindrical portion of said bore.

6. An outlet as claimed in claim 3, wherein said eye ball is retained against axially outwards movement by a circlip located in an angled groove in said countersunk outer end of said bore.

7. An outlet as claimed in claim 3, wherein said eye ball is retained against axially outward movement by a holding ring located in a flat groove in said countersunk outer end of said bore and held therein by screws.

8. An outlet as claimed in claim 4, wherein said flange engages a sealing ring to seal said outlet against a wall of a pool.

* * * * *

UNITED STATES PATENT AND TRADEMARK OFFICE

CERTIFICATE OF CORRECTION

PATENT NO. : 4,262,371

DATED : April 21, 1981

INVENTOR(S) : DESMOND J. BERRY and LARRY BLANKFIELD

It is certified that error appears in the above-identified patent and that said Letters Patent are hereby corrected as shown below:

Column 2, line 25, change "radically" to --radially--;

Column 4, line 57, change "claim 3" to --claim 4--;

Column 4, line 61, change "claim 3" to --claim 4--.

Signed and Sealed this

*Eighth* Day of *September 1981*

[SEAL]

*Attest:*

GERALD J. MOSSINGHOFF

*Attesting Officer*

*Commissioner of Patents and Trademarks*